US005368508A

United States Patent [19]

Whittington

[11] Patent Number: 5,368,508

[45] Date of Patent: Nov. 29, 1994

[54] MARINE PROPELLER WITH TRANSVERSAL CONVERGING RIBS

[76] Inventor: Burl D. Whittington, 5960 Southwest 40th Ave., Apt. C5, Fort Lauderdale, Fla. 33314

[21] Appl. No.: 73,754

[22] Filed: Jun. 8, 1993

[51] Int. Cl.[5] ..... B63H 1/14

[52] U.S. Cl. ..... 440/49; 416/236 A

[58] Field of Search ..... 440/49; 416/235, 236, 416/236 A

[56] References Cited

U.S. PATENT DOCUMENTS

| | | | |
|---|---|---|---|
| 28,688 | 6/1860 | Porter . | |
| 1,424,672 | 8/1922 | Ogissek | 416/236 A |
| 1,758,560 | 5/1930 | Currie | 416/236 A |
| 2,498,170 | 2/1950 | Meier | 416/236 A |
| 3,294,175 | 12/1966 | Bodner | 416/236 A |
| 4,128,363 | 12/1978 | Fujikake | 416/236 A |
| 4,265,596 | 5/1981 | Katagiri et al. | 416/236 A |
| 4,757,587 | 7/1988 | Choi | 29/156.8 P |
| 5,193,983 | 3/1993 | Shyu | 416/236 A |

FOREIGN PATENT DOCUMENTS 9930 of 1891 United Kingdom .

*Primary Examiner*—Jesus D. Sotelo

*Attorney, Agent, or Firm*—Malin, Haley, DiMaggio & Crosby

[57] ABSTRACT

A marine propeller which includes arcuate ribs extending from each blade surface. Each rib is widely spaced at the blade's leading edge and curves inwardly towards the propeller hub to substantially converge at the blade's trailing edge. Each rib is further configured so as its height above the blade surface is highest at the blade's trailing edge and is tapered to a lower height at the leading edge. This rib configuration provides a greater blade surface area to produce greater thrust and overall higher propeller efficiency.

4 Claims, 5 Drawing Sheets

MARINE PROPELLER WITH TRANSVERSAL CONVERGING RIBS

BACKGROUND OF THE INVENTION

1. Field of the Invention

This invention relates generally to a propeller used to produce thrust when driven by a marine propulsion system, and more particularly, to a marine propeller which is capable of replacing a conventional marine propeller and includes a series of arcuate ribs on each blade used to increase hydrodynamic efficiency.

2. Description of the Prior Art

A propeller often is defined as a bladed device that rotates on a shaft to produce thrust in the direction of the shaft axis. Propellers are used in a wide variety of applications, including mechanical and electrical air fans, aircraft, and boating. In a marine environment, the propeller attached to a motor is the means by which the vessel or boat is driven through the water. Marine propellers may operate either clockwise or counterclockwise in relation to the boat's stern and may be shaft or stern-driven. Also, marine propellers are manufactured in a variety of shapes and sizes, depending on application. These types include standard outboard, cleavers, modified cleavers, choppers, and "elephant ears." As the propeller is driven or rotated by the motor, a negative pressure is created on one side of each blade surface while a positive pressure is created on the blade's opposite side. This pressure differential causes water to be drawn into the submerged propeller from an area forward of the rotating blade where it is then pushed or accelerated at a high velocity from its rear.

In the past a number of methods have been used to modify the marine propeller in order to increase propeller efficiency. Increased efficiency allows the propeller to produce more thrust per revolution. One commonly used method is where two or more of the blades of the propeller are offset in a forward direction from a perpendicular line extending through the center of the blade hub. This offset is called the blade rake and increases a boat's ability to operate in both cavitational and ventilation situations. Propeller cavitation is generally the formation of both combustion exhaust vapor and air filled bubbles or cavities in water near or on the surface of the rotating propeller. These cavities occur when their pressure falls below the vapor pressure of water. Ventilation occurs when the blade is either fully or partially exposed from the water while in operation.

A second and more common modification to the propeller includes blade pitch adjustment which is the amount of twist or turn of each blade in relation to the propeller hub. This twist allows the blade to form a helical surface. The propeller pitch is commonly set to determine the amount of water which will be pulled through the propeller per revolution, which in turn produces a corresponding amount of thrust.

A third and less often used method to increase propeller efficiency has been the addition of a supplementary vane or rib blade which extends perpendicular to the propeller surface. This rib helps to draw water from the outer periphery of the blade towards the blade root or hub. This has the overall effect of increasing propeller efficiency since the ratio of thrust horsepower produced by the propeller is increased in relation to the shaft horsepower as delivered by the motor to the propeller. British patent 9930 discloses the use of a propeller which utilizes additional rib blades positioned on a main blade. The ribs protrude from the blade surface at a uniform height and extend linearly from leading edge to trailing edge.

Additionally, U.S. Pat. Nos. 4,757,587, 4,128,363, and 3,294,175 further teach the use of rib configurations which extend across the blade surfaces in order to enhance propeller blade effectiveness. Although these ribs may be present on the blade surface, each rib does not include a cup area, nor are the ribs staggered in height from the center of the hub to the outer tip, nor are they tapered from a leading blade edge to trailing blade edge.

SUMMARY OF THE INVENTION

In accordance with the present invention, a propeller construction used primarily with marine engines comprises several rotatable blades, each extending from a center support section or hub. Each blade includes a plurality of arcuate ribs which extend transversely on the forward blade surface from the leading edge of the blade to the trailing edge. The ribs are widely spaced at the leading edge and are positioned so as to arc inwardly towards the propeller boss or hub, substantially converging at the blade's trailing edge. Each rib is further characterized by its unique height in that the rib protrudes upwardly from the blade surface and forms a gradient so that the rib height at the blade's trailing edge is greater than the rib height at the blade's leading edge. Moreover, the innermost rib, closest to the blade hub, has the lowest mean height as compared with the subsequent ribs extending outwardly from the blade hub. This provides a staggered rib configuration which traps water passing over each rib during rotation from the innermost rib to outwardly extending ribs. The height of each outwardly extending rib may be increased proportionally in size to the rib directly adjacent at its hub side. Further, each rib is slanted or angled inward towards the forward rotation of the blade and includes a curved upper rib cup, which allows each rib to draw and hold a greater amount of water.

It is therefore the principal object of the invention to produce a propeller with arcuate ribs with a unique tilt angle, taper and cup, which will increase each blade's overall efficiency.

It is a further object of the invention to produce a marine propeller that is compatible with an existing marine drive system and will increase both speed and hydrodynamic efficiency while reducing vibration.

It is still further an object of the invention to produce a marine propeller that will decrease the amount of slip produced by a boat while increasing thrust, so as to allow the boat to be in proper trim, increasing boat speed.

It is still further an object of the invention to produce a marine propeller that allows an outboard or stern drive, shaft drive, surface drive, or unit to be mounted higher on the transom, thereby reducing the drag created by a motor mounted lower on the boat stern.

In accordance with these and other objects which will be apparent hereinafter, the instant invention will now become described with particular reference to the accompanying drawings.

DESCRIPTION OF THE PREFERRED EMBODIMENTS

Although the following detailed description is drawn to a propeller with three rib configuration, it should be recognized by those skilled in the art that any number of ribs may be positioned on each blade surface and the optimal number will depend upon propeller size, number of blades, blade configuration, engine horsepower and torque, varying with each individual application.

Figure 1:
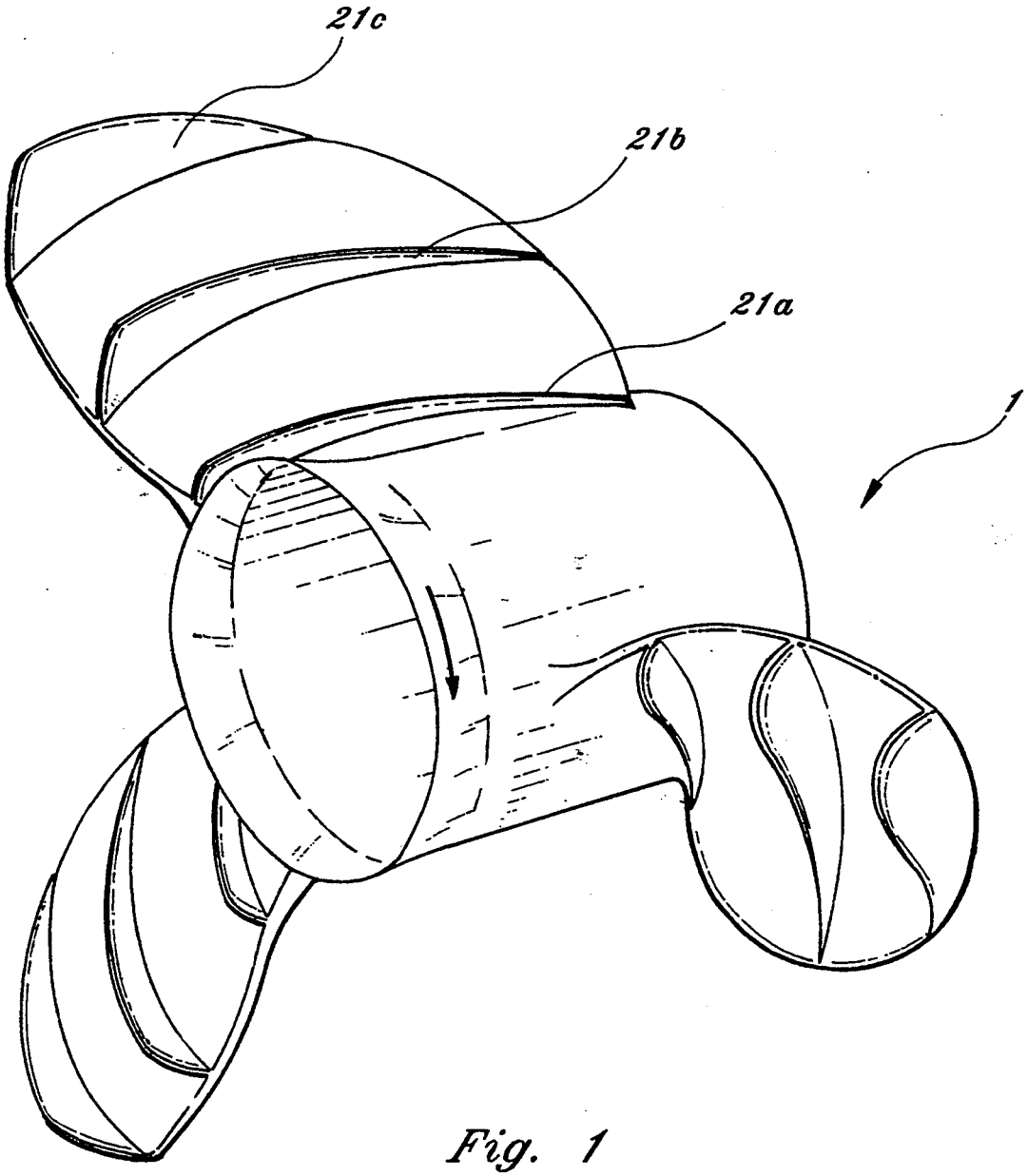
FIG. 1 illustrates a perspective view of the marine propeller of the instant invention.
Figure 2:
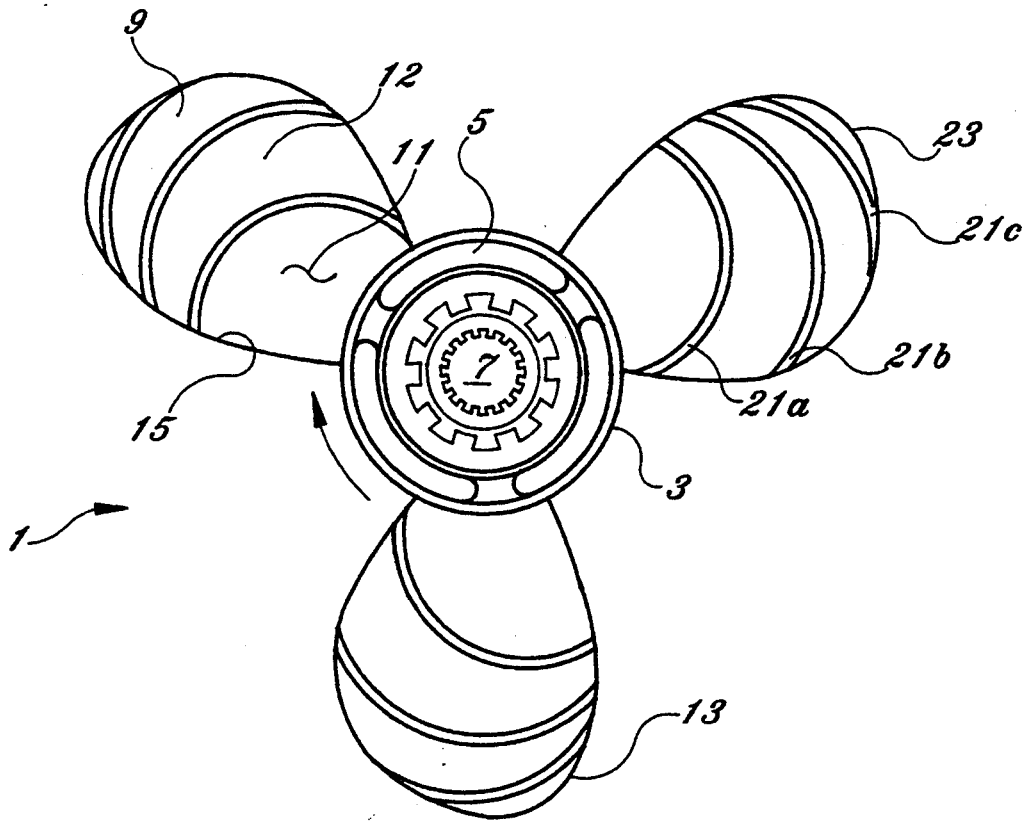
FIG. 2 illustrates a front view of the propeller of the instant invention.

With reference to FIGS. 1 and 2, the outboard propeller generally shown at 1 includes an outer hub 3 and inner hub 5. An exhaust passage 7 extends through the inner hub 5 and acts as an aperture to allow outboard engine exhaust gases to discharge into the water while in operation. A series of blades 9 are fixedly attached to the outer hub 3. Each blade 9 includes a blade back 11, blade face 12, and blade tip 13.

A cup 15 is located on the trailing edge of the blade and is generally defined as a small curve or lip which permits the propeller blade to hold water momentarily within the lip during rotation.

The blade tip 13 separates the leading edge 17 of the blade from the trailing edge 19. The blade tip 13 may be formally defined as the maximum reach of each blade from the center of the inner hub 5. The leading edge 17 is that portion of the blade, which in view of the blade pitch, is nearest to the boat hull and first contacts the blade surface during rotation. The trailing edge 19 is that part of the blade furthest from the boat hull and is the edge from which water leaves the blade. Trailing edge 19 extends from the blade tip 13 to the inner hub 5.

The propeller 1 further includes a plurality of arcuate ribs 21 which are placed on each blade back 11. In the embodiment shown in FIGS. 1–5, a series of three ribs 21*a*, 21*b*, and 21*c* extend from the leading edge 17 to the trailing edge 19 on each blade back 11. Each of the ribs 21*a*, 21*b*, and 21*c* are widely spaced at the leading edge 17, and each bends or arches toward the inner hub 5 at a point 23 and is angled so as to substantially converge as each of the ribs 21*a*, 21*b*, and 21*c* reaches the trailing edge 19 of blade 9.

Figure 2A:
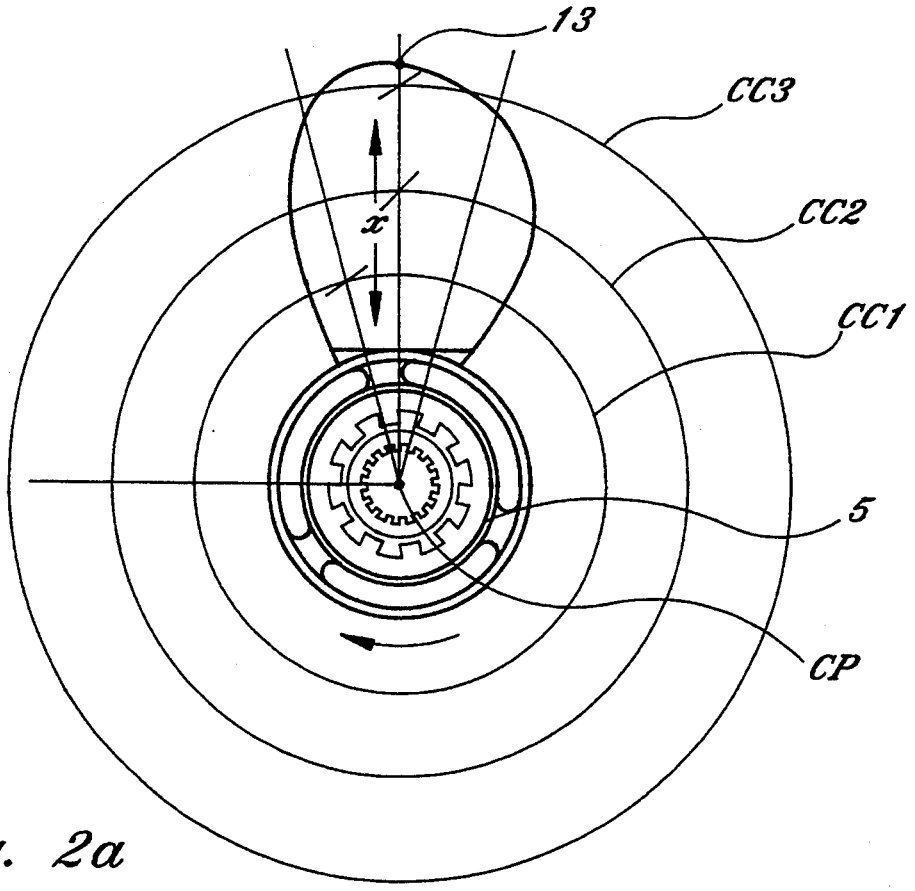
FIGS. 2A and 2B illustrate a top view of the propeller blade and method of positioning ribs thereon.
Figure 2B:
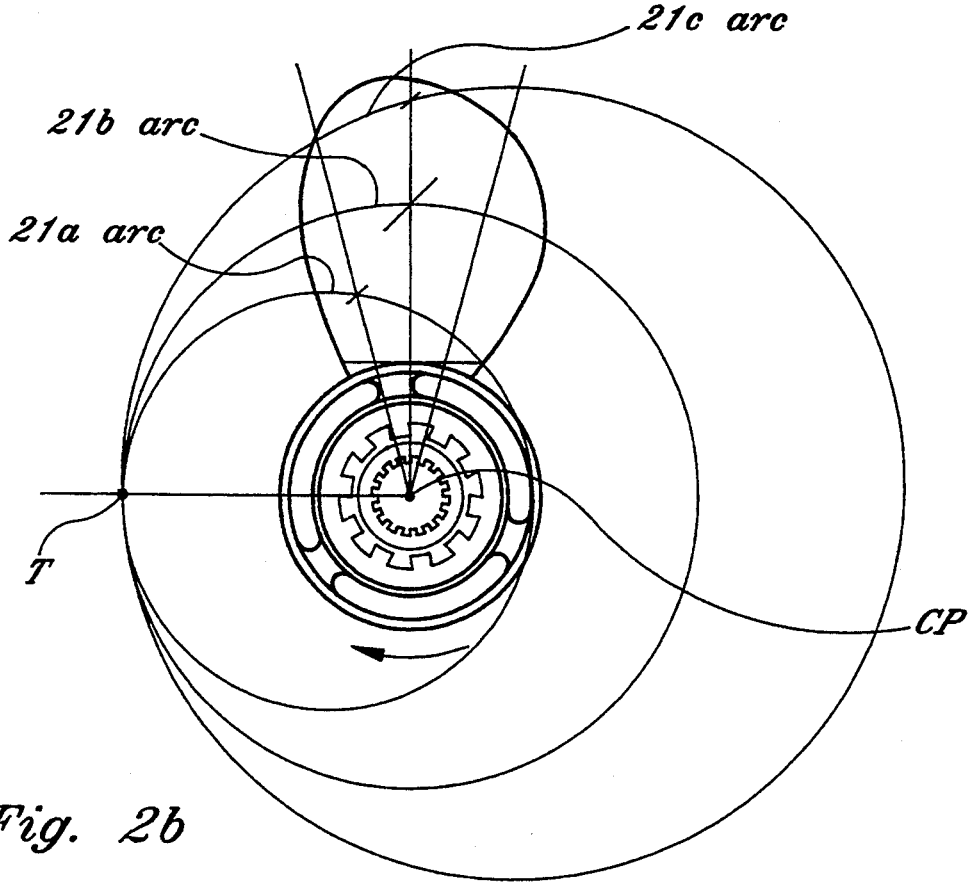

By way of example, one way to position each of the ribs 21*a*, 21*b*, and 21*c* onto blade back 11 is through the use of concentric circles. In FIG. 2A, three concentric circles CC1, CC2, and CC3 are drawn about a center point CP of inner hub 5. The radius of these circles are drawn by using the distance x between center point CP and the blade tip 13. The radius of each of circles CC1, CC2, and CC3 is then calculated by taking a percentage of distance x. In this example, 0.9x, 0.7x, and 0.5x have been used for circles CC3, CC2, and CC1, respectively.

After calculation of each concentric circle radius, circles CC1 and CC3 are next positioned so as to tangentially intersect circle CC2 at point T. Point T is defined as a point substantially 270°, measured from the line at 0° created by points CP and blade tip 13. Movement of CC1 and CC3 creates a series of arcs $21a_{arc}$, $21b_{arc}$, and $21c_{arc}$, which pass across blade back 11. The portion of these arcs which pass across the blade back define a relative position where each of ribs 21*a*, 21*b*, and 21*c* may be initially placed. It should be pointed out that this is only one method which may be used to position ribs and other mathematical methods are possible.

Figure 5B:
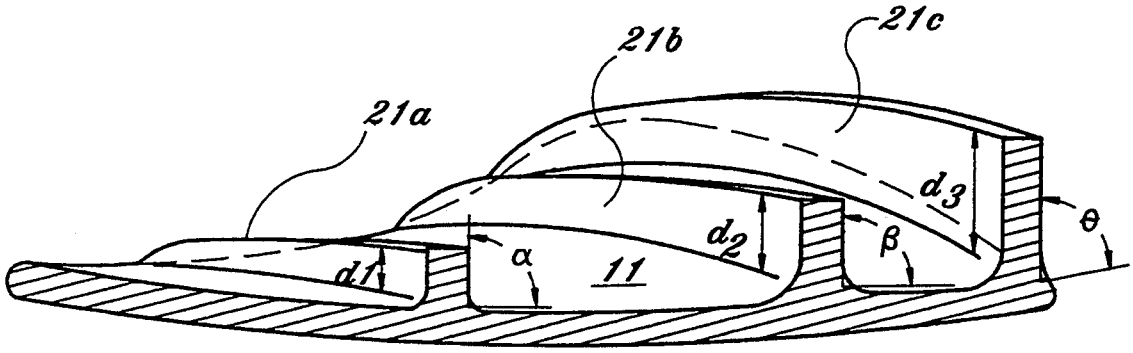
FIG. 5B illustrates a side sectional view of the propeller blade through section lines Vb—Vb shown in FIG. 4.
Figure 5A:
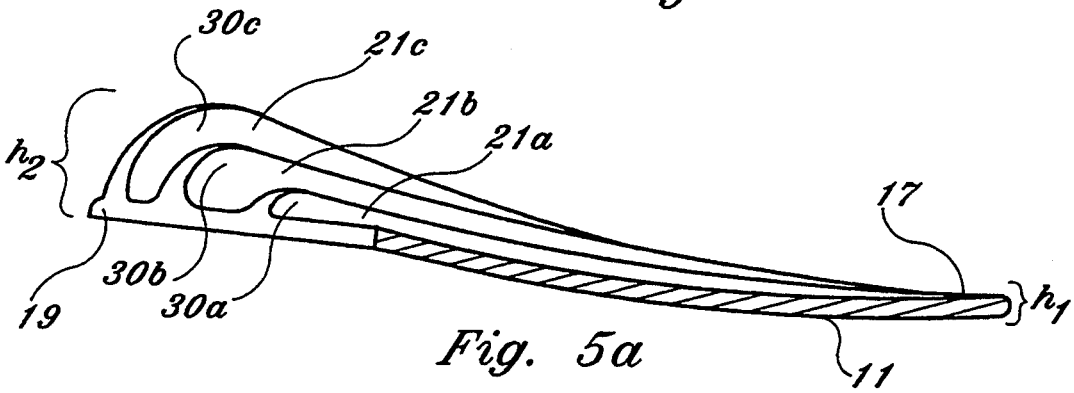
FIG. 5A illustrates a side sectional view of a section of lines Va—Va shown in FIG. 4.

An additional aspect of ribs 21*a*–21*c* is that each is raised and extends substantially perpendicular to the surface of blade back 11. As best seen in FIGS. 5A and 5B, each rib 21*a*, 21*b* and 21*c* has a negligible height $h_1$ at the leading edge 19, which may be substantially flush with the blade back 11 of blade 9. Each of the ribs 21*a* 21*b* and 21*c* increases in height in a gradient, where each ultimately reaches its respective maximum height $h_2$ at the trailing edge of the blade 9. Each respective height varies according to specific application and may also vary according to hub size, motor torque, and horsepower. These engineering parameters are matters of design choice which will be obvious to those skilled in the art.

Figure 4:
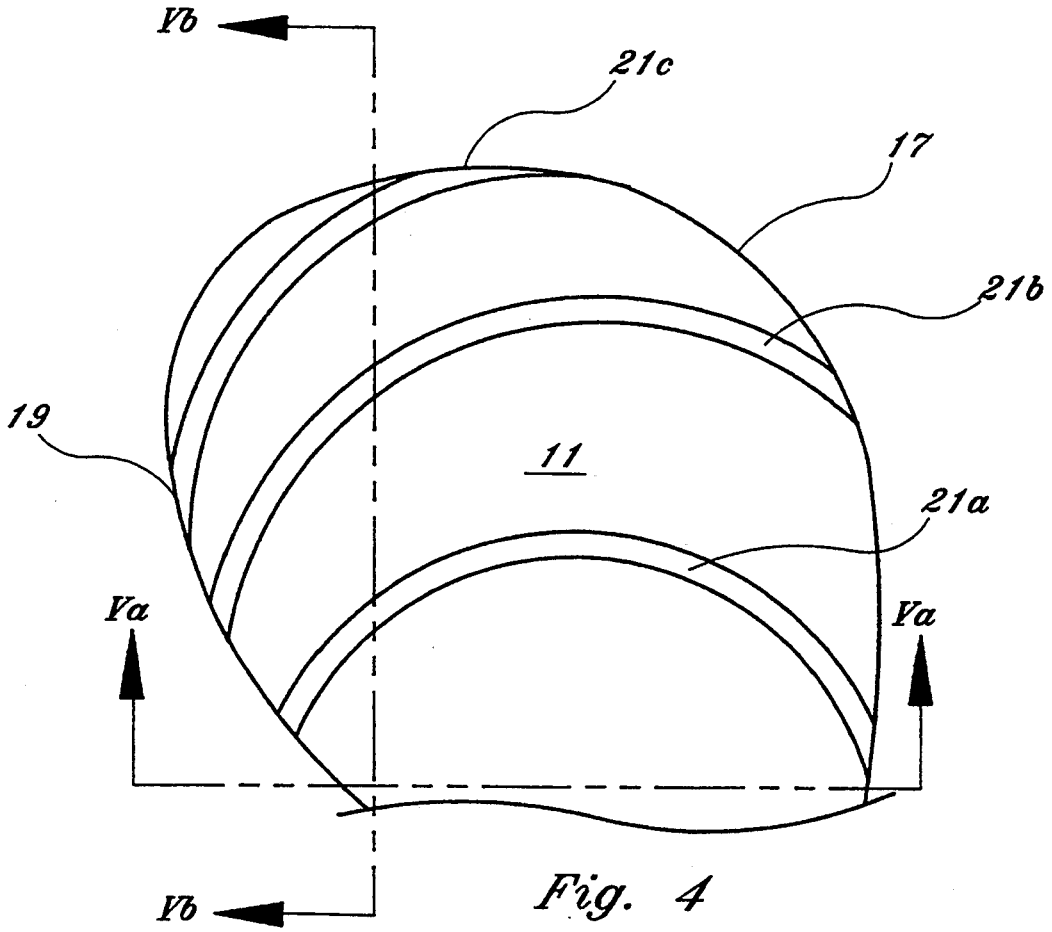
FIG. 4 illustrates an enlarged top view of the propeller blade and the protruding ribs.

In order to more fully show this relationship FIG. 4 illustrates an enlarged top view of ribs 21*a*, 21*b*, and 21*c* extending transversely from the leading edge 17 and substantially converging at the trailing edge 19. FIG. 5A illustrates a side sectional view of the blade 9 drawn through sectional lines Va—Va shown in FIG. 4, showing ribs 21*a*, 21*b*, and 21*c* extending from the leading edge 17 to trailing edge 19, forming a gradient therebetween. Each respective rib is at its lowest height $h_1$ at the leading edge, and slowly tapers to a greater and greater height, reaching its maximum $h_2$ at the blade's trailing edge. FIG. 5A further illustrates that each respective rib increases to its maximum height $h_2$ which is higher than its inwardly adjacent rib. For example, rib 21*b* reaches a greater height than rib 21*a*, and rib 21*c* reaches a greater height than rib 21*b*. This staggered increase in blade height would continue outwardly to each successive rib, no matter how many ribs were used on the blade surface. FIG. 5A further shows a curved upper area or rib cups 30*a*, 30*b*, and 30*c* on each respective rib surface. Each rib cup 30*a*, 30*b*, and 30*c* is a curved area extending along the entire top edge of each respective rib and acts to trap and retain additional water during propeller rotation.

FIG. 5B illustrates a side sectional view drawn from sectional lines Vb—Vb shown also in FIG. 4. Each rib 21*a*, 21*b*, and 21*c* is at a respective height $d_1$, $d_2$, $d_3$ above the blade back 11. This Figure further illustrates that although the ribs may protrude substantially perpendicular from the blade back 11, each is tilted or angled forward at a respective angle $\alpha$, $\beta$, and $\theta$. This forward angle is in the direction of blade rotation and may be set anywhere between 89° and 1°. These angles will depend on specific application since the lesser the forward angle, the greater amount of water will be trapped under each respective rib during rotation.

Figure 6:
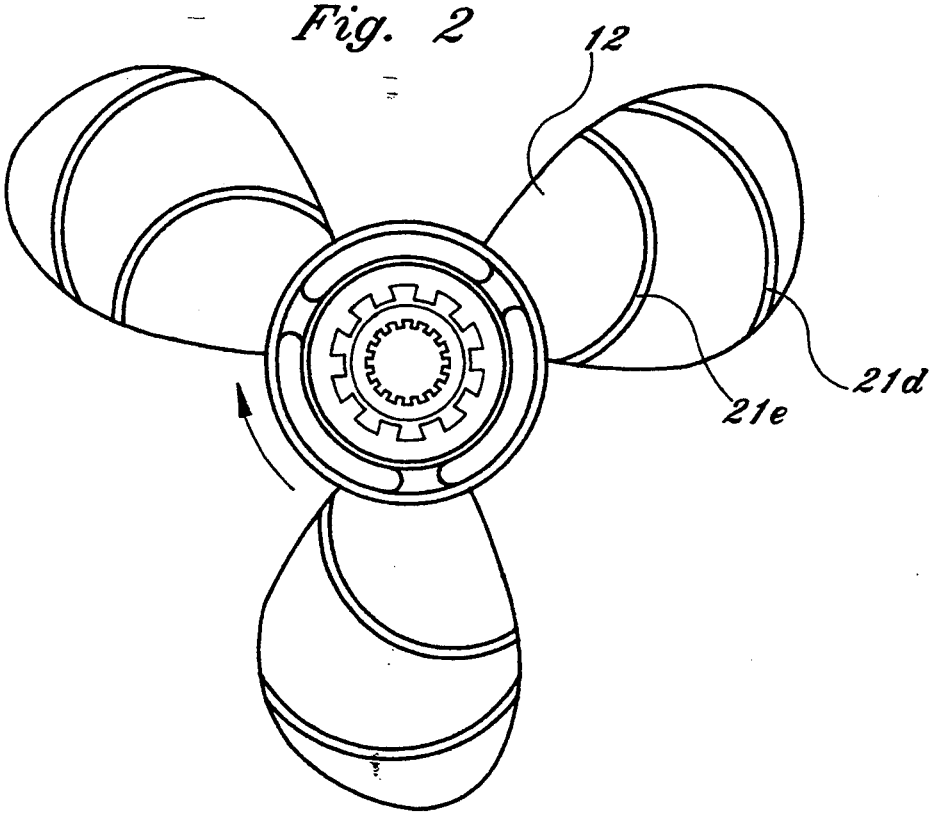
FIG. 6 illustrates an alternative embodiment depicting a two rib configuration on each blade.

FIG. 6 further illustrates an alternative embodiment showing a two rib configuration where ribs 21*d* and 21*e* extend across blade surface 12. This embodiment is different from that described above in that only two ribs extend across each blade back 11. This embodiment offers the advantage of less hydrodynamic drag, yet has the disadvantage of producing less thrust per revolution since only two ribs are present, having an overall lesser surface area.

It should be recognized that the propeller design as described is not limited to any specific number of blades and any number of ribs with various minimum or maximum heights $h_1$ or $h_2$, tilt angles $\alpha$, $\beta$, and $\theta$, or rib cups are possible on any type or number of propeller blades.

OPERATION

Figure 3:
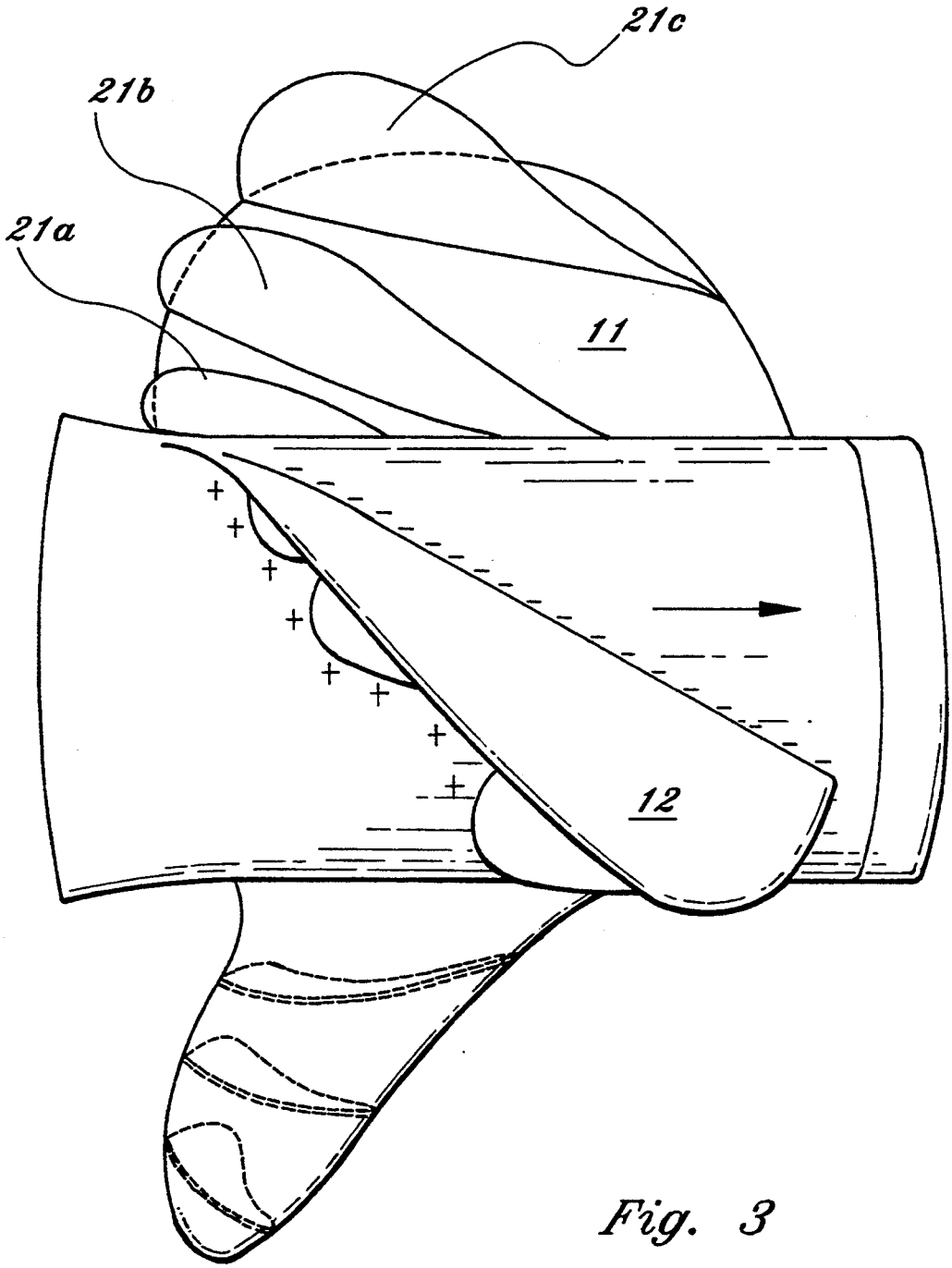
FIG. 3 illustrates a side view of the propeller of the instant invention.

As seen in FIGS. 1 through 3, as blade 9 spins in the direction shown by the arrow, the propeller draws or pulls water in from its front end through an imaginary cylinder approximately the size of the propeller diameter. The front end of propeller 1 is that end that faces the boat rear surface or hull. As the propeller rotates, water accelerates through each blade 9, creating a slightly smaller water stream or jet of higher pressure water behind each of the propeller blades. The water jet exiting the propeller blade is smaller in diameter than the actual diameter of the propeller. This type of water jet action of pulling water in through the propeller blade 9 and pushing it out the rear of the propeller produces a resultant force generally referred to as "thrust." It is this type of pulling and pushing force that drives a boat in a forward direction.

FIG. 2 specifically depicts the propeller 1 moving in a direction shown by the accompanying arrow with the differential pressure areas graphically illustrated. Water is pulled into the propeller and as the propeller 9 rotates downward, water is pushed down and back, away from blade face 12. The thrust produced by the propeller of the instant invention comes to a focal point rearward of the blade, before dispersing. This is distinct from propellers of the prior art, which push water directly from the blade without bringing the water from each blade to a focal area. This results in a greater positive pressure area shown in FIG. 3 by the positive "+" sign. Similarly, water is being drawn in on the top side of the blade as the blade rotates. This results in a negative pressure, illustrated in the drawing by the "−" or negative sign. This negative pressure pulls the propeller along through the water while the resulting opposite positive force acts to simultaneously provide a pushing action.

Due to the increase in overall surface area because of the addition of the ribs, each rib 21*a*, 21*b*, and 21*c* on the blade back 11 acts to more rapidly channel a greater amount of water to the center or inner hub 5 of the propeller 1 than that of a conventional marine propeller. This additional water channeled to the center creates a greater thrust.

Further, the wide gap between ribs at each blade's leading edge 17 acts to gather a greater volume of water towards the blade face 12. These converging ribs have an effect of reducing the cross sectional area normal to the water flow across the blade surface. This decrease in area produces a resulting increase in flow pressure as the water, which is non-compressible, is continually forced or squeezed into a narrower and narrower passage.

The tilt angles $\alpha$, $\beta$, and $\theta$ of ribs 21*a*, 21*b*, and 21*c*, and rib cups 30*a*, 30*b*, and 30*c*, as seen in FIGS. 5A and 5B, trap and retain even a greater amount of water moving across the rib surface. Any water which may escape from under these rib cups moves up and over the top of the respective rib. Since the next outwardly adjacent rib protrudes at a greater height than that which the water escapes, the water moving in that direction is caught in this rib. The water is then pulled underneath the rib cup and the same sequence of events occurs. Hence, this allows even a greater amount of water to be trapped by each rib, producing a greater pressure differential than normally could be achieved between blade back 11 and blade face 12 if a conventional marine propeller design were used.

Overall, the propeller configuration of the instant invention has the advantage of producing less slip and greater thrust, while ultimately allowing a boat using this propeller to attain a higher velocity. The use of arcuate ribs allows the propeller blades to be more hydrodynamically efficient, producing an overall greater thrust per propeller revolution.

In contrast to propellers which are selected for either their off-the-start or high velocity capability, the propeller of the instant invention allows a boat to take off and accelerate from the start at a quicker rate. The propeller allows for both a very quick start while still attaining a high top speed. The propeller produces less wake while in operation, further demonstrating its hydrodynamic efficiency.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A propeller including a plurality of blades attached at a center hub, comprising:

a plurality of arcuate ribs protruding substantially perpendicular from a blade surface at a non-uniform height and extending transversely from the leading edge to the trailing edge of at least one of said plurality of blades, wherein said plurality of arcuate ribs substantially converge at the trailing edge of said at least one blade, wherein the innermost rib in relation to said hub has the lowest mean height of said plurality of ribs and each subsequent rib extending outwardly therefrom has a greater mean height than its inwardly adjacent rib.

2. A propeller according to claim 1, wherein said increase is directly proportional.

3. A propeller including a plurality of blades attached at a center hub, comprising:

a plurality of arcuate ribs protruding at a predetermined angle from a blade surface at a non-uniform height and extending transversely from the leading edge to the trailing edge of at least one of said plurality of blades, wherein said plurality of arcuate ribs substantially converge at the trailing edge of said at least one blade, wherein the innermost rib in relation to said hub has the lowest mean height of said plurality of ribs and each subsequent rib extending outwardly therefrom has a greater mean height than its inwardly adjacent rib.

4. A propeller according to claim 3, wherein said increase is directly proportional.

* * * * *